US008763726B2

(12) United States Patent
Johnson et al.

(10) Patent No.: US 8,763,726 B2
(45) Date of Patent: Jul. 1, 2014

(54) DRILL BIT GAUGE PAD CONTROL

(75) Inventors: Ashley Bernard Johnson, Milton (GB); Michael Charles Sheppard, Hadstock (GB); Geoff Downton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 462 days.

(21) Appl. No.: 12/116,390

(22) Filed: May 7, 2008

(65) Prior Publication Data

US 2009/0044979 A1 Feb. 19, 2009

Related U.S. Application Data

(63) Continuation-in-part of application No. 11/839,381, filed on Aug. 15, 2007.

(51) Int. Cl.
*E21B 44/00* (2006.01)

(52) U.S. Cl.
USPC ..... 175/263; 175/266; 175/285; 175/73; 175/24; 175/55; 175/61

(58) Field of Classification Search
USPC ..... 175/263, 266, 285, 73, 24, 55, 61, 63
See application file for complete search history.

(56) References Cited

U.S. PATENT DOCUMENTS

| | | | |
|---|---|---|---|
| 1,156,147 | A | 10/1915 | Kams |
| 1,638,337 | A | 8/1927 | Hutton |
| 1,667,155 | A | 4/1928 | Higdon |
| 2,010,789 | A | 8/1935 | Roesel |
| 2,016,042 | A | 10/1935 | Lewis |
| 2,238,377 | A | 4/1941 | Strang |
| 2,670,046 | A | 2/1954 | Kinzbach |
| 3,224,513 | A | 12/1965 | Weeden, Jr. |
| 3,285,349 | A | 11/1966 | Brandon |
| 4,190,123 | A | 2/1980 | Roddy |
| 4,211,292 | A | 7/1980 | Evans |
| 4,319,649 | A | 3/1982 | Jeter |
| 4,394,193 | A | 7/1983 | Gfrerer |
| 4,690,229 | A | 9/1987 | Raney |
| 4,739,843 | A | 4/1988 | Burton |

(Continued)

FOREIGN PATENT DOCUMENTS

| | | | |
|---|---|---|---|
| BE | 1012545 | A3 | 12/2000 |
| EP | 0530045 | A1 | 3/1993 |

(Continued)

OTHER PUBLICATIONS

Office Action of Chinese Application No. 200880111732.0 dated Apr. 12, 2013: pp. 1-3.

(Continued)

*Primary Examiner* — James Sayre

(57) ABSTRACT

The present specification describes a drill bit for drilling a cavity. The drill bit may include a chassis, a plurality of gauge pad sets, and at least one gauge pad structure. The chassis may be configured to rotate about an axis. The plurality of gauge pad sets may each include at least one gauge pad. The at least one gauge pad structure may moveably couple at least one of the gauge pads of at least one of the plurality of gauge pad sets with the chassis.

6 Claims, 14 Drawing Sheets

(56) References Cited

U.S. PATENT DOCUMENTS

| | | | | |
|---|---|---|---|---|
| 4,775,017 | A | 10/1988 | Forrest et al. | |
| 4,807,708 | A | 2/1989 | Forrest et al. | |
| 4,842,083 | A * | 6/1989 | Raney | 175/325.4 |
| 4,856,601 | A | 8/1989 | Raney | |
| 5,010,789 | A | 4/1991 | Brett et al. | |
| 5,042,596 | A | 8/1991 | Brett et al. | |
| 5,090,492 | A | 2/1992 | Keith | |
| 5,113,953 | A | 5/1992 | Noble | |
| 5,159,577 | A * | 10/1992 | Twist | 367/25 |
| 5,163,524 | A | 11/1992 | Newton, Jr. et al. | |
| 5,213,168 | A | 5/1993 | Warren et al. | |
| 5,265,682 | A | 11/1993 | Russell et al. | |
| 5,339,910 | A | 8/1994 | Mueller | |
| 5,341,886 | A | 8/1994 | Patton | |
| 5,343,964 | A | 9/1994 | Leroy | |
| 5,361,859 | A | 11/1994 | Tibbitts | |
| 5,423,389 | A | 6/1995 | Warren et al. | |
| 5,490,569 | A | 2/1996 | Brotherton et al. | |
| 5,520,255 | A | 5/1996 | Barr et al. | |
| 5,553,678 | A | 9/1996 | Barr et al. | |
| 5,553,679 | A | 9/1996 | Thorp | |
| 5,560,440 | A | 10/1996 | Tibbitts | |
| 5,582,259 | A | 12/1996 | Barr | |
| 5,603,385 | A | 2/1997 | Colebrook | |
| 5,641,421 | A | 6/1997 | Manov et al. | |
| 5,649,604 | A | 7/1997 | Fuller et al. | |
| 5,651,421 | A | 7/1997 | Newton et al. | |
| 5,673,763 | A * | 10/1997 | Thorp | 175/73 |
| 5,685,379 | A | 11/1997 | Barr et al. | |
| 5,695,015 | A | 12/1997 | Barr et al. | |
| 5,697,461 | A | 12/1997 | Newton et al. | |
| 5,706,905 | A | 1/1998 | Barr | |
| 5,778,992 | A | 7/1998 | Fuller | |
| 5,803,185 | A | 9/1998 | Barr et al. | |
| 5,803,196 | A | 9/1998 | Fielder | |
| 5,836,406 | A | 11/1998 | Schuh | |
| 5,971,085 | A | 10/1999 | Colebrook | |
| 5,979,577 | A | 11/1999 | Fielder | |
| 6,089,332 | A | 7/2000 | Barr et al. | |
| 6,092,610 | A | 7/2000 | Kosmala et al. | |
| 6,142,250 | A | 11/2000 | Griffin et al. | |
| 6,158,529 | A | 12/2000 | Dorel | |
| 6,244,361 | B1 | 6/2001 | Comeau et al. | |
| 6,257,356 | B1 * | 7/2001 | Wassell | 175/61 |
| 6,290,007 | B2 | 9/2001 | Beuershausen et al. | |
| 6,360,831 | B1 | 3/2002 | Akesson et al. | |
| 6,364,034 | B1 | 4/2002 | Schoeffler | |
| 6,394,193 | B1 | 5/2002 | Askew | |
| 6,427,792 | B1 * | 8/2002 | Roberts et al. | 175/431 |
| 6,601,658 | B1 | 8/2003 | Downton | |
| 6,604,658 | B1 | 8/2003 | Young et al. | |
| 6,629,476 | B2 | 10/2003 | Fielder et al. | |
| 6,904,984 | B1 | 6/2005 | Estes et al. | |
| 6,971,459 | B2 | 12/2005 | Raney | |
| 7,090,037 | B2 | 8/2006 | Best | |
| 7,201,237 | B2 | 4/2007 | Raney | |
| 7,287,604 | B2 | 10/2007 | Aronstam | |
| 7,308,955 | B2 | 12/2007 | Barton et al. | |
| 7,757,784 | B2 | 7/2010 | Fincher et al. | |
| 7,762,356 | B2 | 7/2010 | Turner et al. | |
| 7,845,430 | B2 | 12/2010 | Johnson et al. | |
| 7,971,661 | B2 | 7/2011 | Johnson et al. | |
| 7,971,662 | B2 | 7/2011 | Beuershausen | |
| 8,066,085 | B2 | 11/2011 | Johnson et al. | |
| 8,087,479 | B2 | 1/2012 | Kulkarni et al. | |
| 2001/0052428 | A1 | 12/2001 | Larronde et al. | |
| 2002/0011359 | A1 | 1/2002 | Webb et al. | |
| 2002/0020565 | A1 | 2/2002 | Hart et al. | |
| 2002/0053470 | A1 | 5/2002 | Noe et al. | |
| 2002/0088649 | A1 | 7/2002 | Morris, Sr. et al. | |
| 2003/0056991 | A1 | 3/2003 | Hahn et al. | |
| 2004/0099444 | A1 | 5/2004 | Chen et al. | |
| 2004/0216921 | A1 | 11/2004 | Krueger | |
| 2005/0056463 | A1 | 3/2005 | Aronstam et al. | |
| 2005/0236187 | A1 | 10/2005 | Chen et al. | |
| 2005/0269082 | A1 | 12/2005 | Baron et al. | |
| 2006/0157277 | A1 | 7/2006 | Bittar et al. | |
| 2006/0196697 | A1 | 9/2006 | Raney | |
| 2006/0237234 | A1 | 10/2006 | Dennis et al. | |
| 2006/0249287 | A1 | 11/2006 | Downton et al. | |
| 2007/0007000 | A1 | 1/2007 | Dewey et al. | |
| 2007/0205022 | A1 * | 9/2007 | Treviranus et al. | 175/61 |
| 2007/0272445 | A1 | 11/2007 | Cariveau et al. | |
| 2008/0000693 | A1 * | 1/2008 | Hutton | 175/61 |
| 2008/0115974 | A1 | 5/2008 | Johnson et al. | |
| 2009/0044977 | A1 | 2/2009 | Johnson et al. | |
| 2009/0044979 | A1 | 2/2009 | Johnson | |
| 2009/0044980 | A1 | 2/2009 | Sheppard et al. | |
| 2009/0044981 | A1 | 2/2009 | Sheppard et al. | |
| 2009/0065262 | A1 | 3/2009 | Downton et al. | |
| 2009/0188720 | A1 | 7/2009 | Johnson et al. | |
| 2009/0194334 | A1 | 8/2009 | Johnson et al. | |
| 2010/0038141 | A1 | 2/2010 | Johnson et al. | |
| 2012/0018224 | A1 | 1/2012 | Johnson et al. | |
| 2012/0090897 | A1 | 4/2012 | Johnson et al. | |

FOREIGN PATENT DOCUMENTS

| | | | | |
|---|---|---|---|---|
| EP | 530045 | A1 * | 3/1993 | E21B 7/06 |
| EP | 0707131 | A2 | 4/1996 | |
| EP | 0707131 | A3 | 10/1996 | |
| EP | 1227214 | A2 | 7/2002 | |
| EP | 0707131 | | 12/2002 | |
| EP | 1227214 | A3 | 3/2003 | |
| EP | 1227214 | | 6/2004 | |
| GB | 2257182 | A | 1/1993 | |
| GB | 2285651 | A | 7/1995 | |
| GB | 2304759 | A | 3/1997 | |
| GB | 2343470 | A | 5/2000 | |
| GB | 2355744 | A | 5/2001 | |
| GB | 2367626 | A | 4/2002 | |
| GB | 2408526 | A | 8/2006 | |
| GB | 2423102 | A | 8/2006 | |
| GB | 2423546 | A | 8/2006 | |
| GB | 2425790 | A | 11/2006 | |
| GB | 2439661 | A | 1/2008 | |
| RU | 2006560 | | 1/1994 | |
| RU | 2029047 | | 2/1995 | |
| RU | 2072419 | | 1/1997 | |
| RU | 2100559 | | 12/1997 | |
| RU | 2239042 | | 10/2004 | |
| RU | 2006100565 | | 7/2007 | |
| WO | 9619635 | A1 | 6/1996 | |
| WO | 9747848 | A1 | 12/1997 | |
| WO | 9815710 | A1 | 4/1998 | |
| WO | 9928587 | A1 | 6/1999 | |
| WO | 0121927 | A2 | 3/2001 | |
| WO | 0236924 | A2 | 5/2002 | |
| WO | 03/004824 | A1 | 1/2003 | |
| WO | 03052237 | A1 | 6/2003 | |
| WO | 03/097989 | A1 | 11/2003 | |
| WO | 2004104360 | A2 | 12/2004 | |
| WO | 2004113664 | A1 | 12/2004 | |
| WO | 2006012186 | A1 | 2/2006 | |
| WO | 2007012858 | A1 | 2/2007 | |
| WO | 2007036722 | | 4/2007 | |

OTHER PUBLICATIONS

Dictionary definition of "geostationary" accessed Feb. 24, 2012: p. 1, <http://www.thefreedictionary.com/p/geostationary>.

* cited by examiner

DRILL BIT GAUGE PAD CONTROL

This application claims the benefit of and is a continuation-in-part of co-pending U.S. application Ser. No. 11/839,381 filed on Aug. 15, 2007, entitled SYSTEM AND METHOD FOR CONTROLLING A DRILLING SYSTEM FOR DRILLING A BOREHOLE IN AN EARTH FORMATION, which is hereby expressly incorporated by reference in its entirety for all purposes.

This application is related to U.S. patent application Ser. No. 12/116,380, filed on the same date as the present application, entitled "STOCHASTIC BIT NOISE CONTROL," which is incorporated by reference in its entirety for all purposes.

This application is related to U.S. patent application Ser. No. 12/116,408, filed on the same date as the present application, entitled "SYSTEM AND METHOD FOR DIRECTIONALLY DRILLING A BOREHOLE WITH A ROTARY DRILLING SYSTEM," which is incorporated by reference in its entirety for all purposes.

This application is related to U.S. patent application Ser. No. 12/116,444, filed on the same date as the present application, entitled "METHOD AND SYSTEM FOR STEERING A DIRECTIONAL DRILLING SYSTEM," which is incorporated by reference in its entirety for all purposes.

BACKGROUND OF THE INVENTION

The present invention relates generally to drilling. More specifically, but not by way of limitation, embodiments relate to controlling the direction of boreholes drilled in earthen formations.

In many industries, it is often desirable to directionally drill a borehole through an earth formation or core a hole in sub-surface formations in order that the borehole and/or coring may circumvent and/or pass through deposits and/or reservoirs in the formation to reach a predefined objective in the formation and/or the like. When drilling or coring holes in sub-surface formations, it is sometimes desirable to be able to vary and control the direction of drilling, for example to direct the borehole towards a desired target, or control the direction horizontally within an area containing hydrocarbons once the target has been reached. It may also be desirable to correct for deviations from the desired direction when drilling a straight hole, or to control the direction of the hole to avoid obstacles.

In the hydrocarbon industry for example, a borehole may be drilled so as to intercept a particular subterranean-formation at a particular location. In some drilling processes, to drill the desired borehole, a drilling trajectory through the earth formation may be pre-planned and the drilling system may be controlled to conform to the trajectory. In other processes, or in combination with the previous process, an objective for the borehole may be determined and the progress of the borehole being drilled in the earth formation may be monitored during the drilling process and steps may be taken to ensure the borehole attains the target objective. Furthermore, operation of the drill system may be controlled to provide for economic drilling, which may comprise drilling so as to bore through the earth formation as quickly as possible, drilling so as to reduce bit wear, drilling so as to achieve optimal drilling through the earth formation and optimal bit wear and/or the like.

One aspect of drilling is called "directional drilling." Directional drilling is the intentional deviation of the wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

The monitoring process for directional drilling of the borehole may include determining the location of the drill bit in the earth formation, determining an orientation of the drill bit in the earth formation, determining a weight-on-bit of the drilling system, determining a speed of drilling through the earth formation, determining properties of the earth formation being drilled, determining properties of a subterranean formation surrounding the drill bit, looking forward to ascertain properties of formations ahead of the drill bit, seismic analysis of the earth formation, determining properties of reservoirs etc. proximal to the drill bit, measuring pressure, temperature and/or the like in the borehole and/or surrounding the borehole and/or the like. In any process for directional drilling of a borehole, whether following a pre-planned trajectory, monitoring the drilling process and/or the drilling conditions and/or the like, it is necessary to be able to steer the drilling system.

Forces which act on the drill bit during a drilling operation include gravity, torque developed by the bit, the end load applied to the bit, and the bending moment from the drill assembly. These forces together with the type of strata being drilled and the inclination of the strata to the bore hole may create a complex interactive system of forces during the drilling process.

Known methods of directional drilling include the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling.

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottomhole assembly ("BHA") in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the BHA close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953, all of which are hereby incorporated by reference, for all purposes, as if fully set forth herein.

In a push-the-bit rotary steerable, the requisite non-collinear condition is achieved by causing either or both of the upper or lower stabilizers or another mechanism to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085, all of which are hereby incorporated by reference, for all purposes, as if fully set forth herein.

Known forms of RSS are provided with a "counter rotating" mechanism which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geo-stationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator presses a pad against the borehole wall in the opposite direction from the desired deviation. The result is that the drill bit is pushed in the desired direction.

The force generated by the actuators/pads is balanced by the force to bend the bottomhole assembly, and the force is reacted through the actuators/pads on the opposite side of the bottomhole assembly and the reaction force acts on the cutters of the drill bit, thus steering the hole. In some situations, the force from the pads/actuators may be large enough to erode the formation where the system is applied.

For example, the Schlumberger™ Powerdrive™ system uses three pads arranged around a section of the bottomhole assembly to be synchronously deployed from the bottomhole assembly to push the bit in a direction and steer the borehole being drilled. In the system, the pads are mounted close, in a range of 1-4 ft behind the bit and are powered/actuated by a stream of mud taken from the circulation fluid. In other systems, the weight-on-bit provided by the drilling system or a wedge or the like may be used to orient the drilling system in the borehole.

While system and methods for applying a force against the borehole wall and using reaction forces to push the drill bit in a certain direction or displacement of the bit to drill in a desired direction may be used with drilling systems including a rotary drilling system, the systems and methods may have disadvantages. For example such systems and methods may require application of large forces on the borehole wall to bend the drill-string and/or orient the drill bit in the borehole; such forces may be of the order of 5 kN or more, that may require large/complicated downhole motors or the like to be generated. Additionally, many systems and methods may use repeatedly thrusting of pads/actuator outwards into the borehole wall as the bottomhole assembly rotates to generate the reaction forces to push the drill bit, which may require complex/expensive/high maintenance synchronizing systems, complex control systems and/or the like.

Drill bits are known to "dance" or clatter around in a borehole in an unpredictable or even random manner. The dancing may involve motion of the drill bit in the borehole and/or random variations of reaction forces between the drill bit and an inner-wall of the borehole. This stochastic movement and/or stochastic reactionary force interaction is generally non-deterministic in that a current state does not fully determine its next state. Point-the-bit and push-the-bit techniques are used to force a drill bit into a particular direction and overcome the tendency for the drill bit to stochastically clatter. These techniques ignore the stochastic dance a drill bit is likely to make in the absence of directed forces.

BRIEF DESCRIPTION OF THE INVENTION

In one embodiment, a drill bit for drilling a cavity/borehole is provided. The drill bit may include a chassis or the like, a plurality of gauge pad sets, and at least one gauge pad structure. The chassis may be configured to rotate about an axis. The plurality of gauge pad sets may each include at least one gauge pad. The at least one gauge pad structure may moveably couple at least one of the gauge pads of at least one of the plurality of gauge pad sets with the chassis.

In another embodiment, a method for drilling a cavity/borehole is provided. The method may include rotating a chassis about an axis, where the chassis may include a plurality of cutters and a plurality of gauge pad sets each including at least one gauge pad. The method may also include moving at least one of the gauge pads of at least one of the plurality of gauge pad sets toward or away from the axis.

In another embodiment, a system for drilling a cavity/borehole is provided. The system may include a first means, a plurality of gauge pad sets, and a second means. The first means may be for receiving and transferring rotational motion. The first means may include a chassis. The plurality of gauge pad sets may each include at least one gauge pad. The second means may be for moveably coupling at least one of the gauge pads of at least one of the plurality of gauge pad sets with the first means. The second means may include a gauge pad structure.

BRIEF DESCRIPTION OF THE DRAWINGS

The present invention is described in conjunction with the appended figures.

Figure 1A:
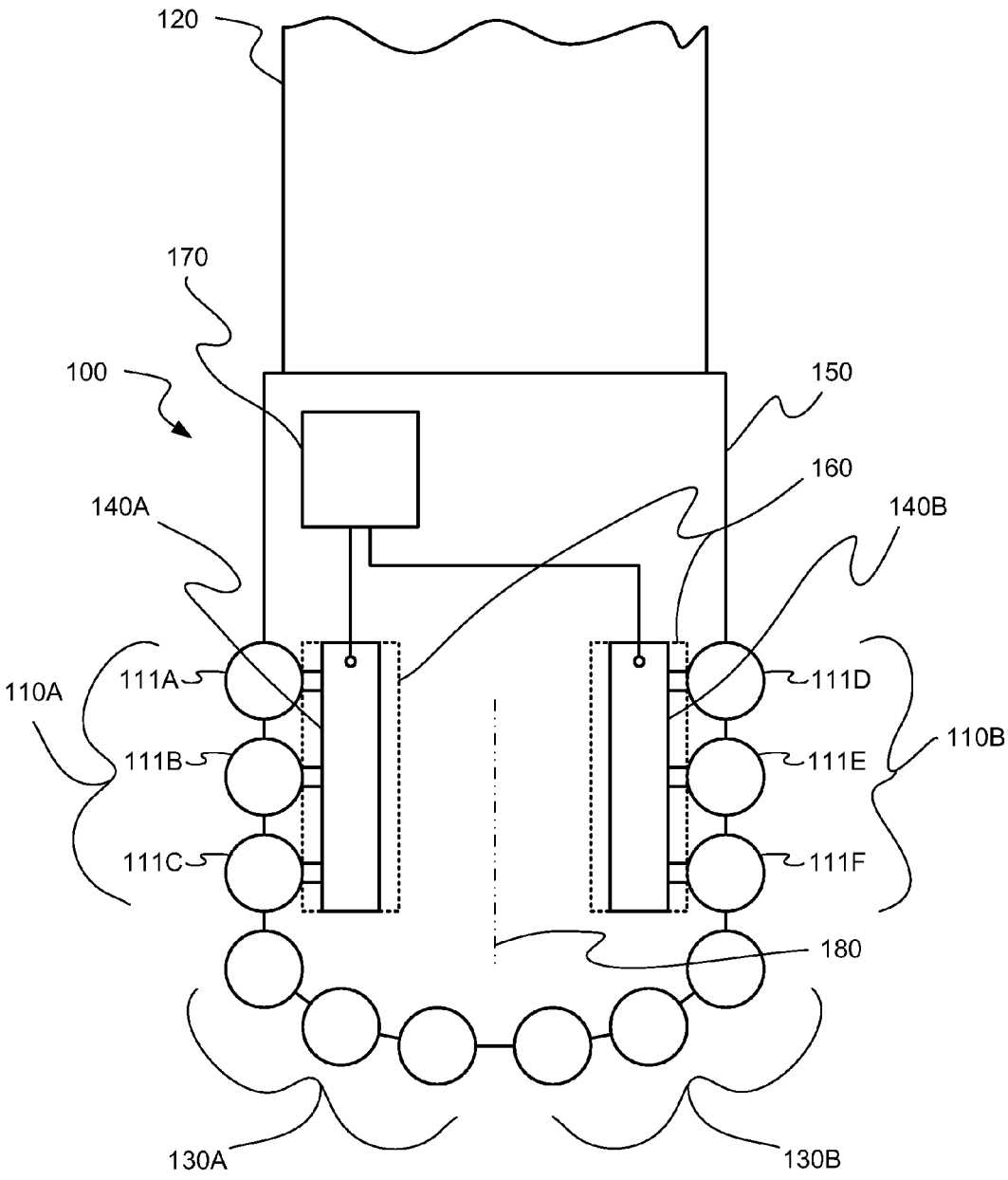
FIG. 1A is a sectional schematic view of a drill bit or system embodiment of the invention for drilling a cavity where the position of each gauge pad set is controlled as a group.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It will be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, networks, processes, and other elements in the invention may be shown as components in block diagram form in order not to obscure the embodiments in unnecessary detail. In other instances, well-known circuits, processes, algorithms, structures, and techniques may be shown without unnecessary detail in order to avoid obscuring the embodiments.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor or processors may perform at least some of the necessary tasks.

In one embodiment of the invention, a drill bit for drilling a cavity/borehole is provided. The drill bit may include a chassis, a plurality of gauge pad sets, and at least one gauge pad structure. The chassis may be configured to rotate about an axis. The plurality of gauge pad sets may each include at least one gauge pad. The at least one gauge pad structure may moveably couple at least one of the gauge pads of at least one of the plurality of gauge pad sets with the chassis.

In some embodiments, the drill bit may be a polycrystalline diamond compact ("PDC") drill bit having PDC cutters in proximity to the end of the drill bit, and PDC gauge pads on the side of the drill bit. The gauge pads may be grouped into gauge pads sets, with each set extending substantially along a line along the length of the side of the drill bit. Each gauge pad set may include at least one gauge pad, but in many embodiments will include any number of a plurality of gauge pads. Each gauge pad set may substantially correspond with a cutter or set of cutters on the end of the drill bit. Any number of cutter sets and gauge pad sets may be present on a given embodiment. In some embodiments, one or more cutters and/or gauge pads may be rigidly coupled with the chassis.

In some embodiments, the gauge pad structure may include any one or more systems to movably couple the relevant gauge pad(s) with the chassis. In some embodiments, the gauge pad structure may thus possibly include hydraulic piston(s), spring(s), magnetorheological fluid piston(s), electrorheological fluid piston(s), electroactive polymer piston (s), mechanical actuators (for example, screw jack and rotary actuators), and/or electric actuators (for example, electromagnetic, electrostatic, magnetostrictive and piezoelectric actuators). In some embodiments, the gauge pad structure may be powered by a mud system or by wireline. In some embodiments, the mud system of the drill bit may directly power the gauge pad structure(s).

In other embodiments, the mud system may be used to power another system which in-turn powers the gauge pad structure(s). Merely by way of example, the mud system, the flow of mud in the drilling system etc., may power a hydraulic circuit, magnetorheological fluid circuit, electrorheological fluid circuit, electroactive polymer circuit or other system which itself powers movement of the gauge pad structure.

In some embodiments, the gauge pad structure(s) may move gauge pad(s) in a radial direction relative to the axis of the drill bit. Merely by way of example, in some embodiments the gauge pad(s) may be moved in a vector perpendicular to the axis of the drill bit. In other embodiments, the gauge pad(s) may be moved in a vector either in an obtuse or acute angle to a vector along the axis in the direction of the end of the drill bit.

In some embodiments the gauge pad structure may directly move a first gauge pad or first set of gauge pads, and a second gauge pad or second set of gauge pads may be configured to coupled via a proportional or un-proportional linkage to automatically move when the first gauge pad or first set of gauge pads is moved. In some embodiments, multiple arrangements of such interlinked systems may exist in a single drill bit.

In some embodiments, the difference in diameter between the fully retracted position of the cutters (inward toward the axis of the drill bit), and the fully extending position of the cutter may be of the order of millimeters and may only be about one (1) millimeter. In these or other embodiments, the diameter established by the gauge pads on the drill bit may be variable between about one millimeter less than the diameter established by the cutters and about one millimeter greater than the diameter established by the cutters. In other embodiments, significantly larger displacements of the gauge pads are also possible, including ranges of tens of millimeters and greater.

In some embodiments, the position of the cutters on the drill bit may also be variable. Systems and methods related to such variable position cutters are discussed in U.S. patent application Ser. No. 11/923,160, entitled "MORPHIBLE (DIRECTIONAL) BIT BY SMART MATERIALS" filed on Oct. 24, 2007, and hereby incorporated by reference, for all purposes, as if fully set forth herein.

In some embodiments, the drill bit, and/or associated systems, may also include a control system configured to control the positions of the gauge pads. Merely by way of example, the control system may be configured to either independently, or via instructions/commands from a user or other system, control the position of one or more gauge pads based at least in part on a rotational position and/or speed of the chassis as it rotates.

In these or other embodiments, the control system may also control the position of one or more gauge pads based at least in part on a presence or an absence of a stochastic motion of the chassis. System and methods related to control of drilling systems with relation to stochastic motion of such drilling systems are discussed in U.S. patent application Ser. No. 12/116,380, filed on the same date as the present application, entitled "STOCHASTIC BIT NOISE CONTROL," and hereby incorporated by reference, for all purposes, as if fully set forth herein. Merely by way of example, gauge pads may be extended or retracted to induce stochastic motion, or to harness the energy of such motion.

In some embodiments, the control system may control the gauge pad structures to affect stability and respond to side forces on the bit. In some embodiments, the control system may be configured to introduce stochastic motion into the bit, which may then be harnessed through further control of the gauge pad structures or through other means. In other embodiments, the control system may be configured to control the gauge pads so as to control/bias stochastic motion of the drill bit to provide for directional drilling of the borehole.

In some embodiments, the control system may control the gauge pad structures to change the diameter of the entire gauge padding of the drill bit; the profiles of gauge pad sets, including introduction of taper into one or more gauge pad set; the length of gauge pad sets; and/or any other aspect of gauge pad set geometry.

In some embodiments, such techniques may optimize steering of the bit via other means. In these or other embodiments, gauge pad control may control the depth of cut of the drill bit, the rate of progress of the drill bit, and/or assist in adjusting the amount of stick-slip occurrence.

In some embodiments, the gauge pad structures may be instructed by the control system and/or may be configured to be responsive via varying degrees of stiffness and/or in the positioning of the gauge pads. In these or other embodiments, specific vibration effects may be tuned out of the system or biased/tuned to produce a desired vibration via gauge pad positioning and/or stiffening. Merely by way of example, whirling tendencies may also be reducing by variable control of the gauge pad positions (extension of the gauge pads). In the same manner, over gauge cavities may also be drilled when desired via gauge pad control.

In some embodiments, the control system may also be in communication with a monitoring system or systems which may measure the radial gap to the borehole wall as the bit turns. Merely by way of example, such monitoring systems could include ultrasonic pulse echo systems or the like. These monitoring systems may be used to estimate average lateral movement per revolution, thereby informing the control system regarding the positioning of the gauge pads.

In another embodiment of the invention, a method for drilling a cavity is provided. Some methods may include use of the systems described herein. In one embodiment, the method may include rotating a chassis about an axis, where the chassis may include a plurality of cutters and a plurality of gauge pad sets each including at least one gauge pad. The method may also include moving at least one of the gauge pads of at least one of the plurality of gauge pad sets toward or away from the axis.

In some embodiments, moving at least one of the gauge pads of at least one of the plurality of gauge pad sets may include moving all the gauge pads of one of the plurality of gauge pad sets toward the axis, and moving all the gauge pads of another of the plurality of gauge pad sets away from the axis. Merely by way of example, one gauge pad set on one side of the drill bit may be extended outward from the axis, while another gauge pad set on the substantially opposite side of the drill bit may be retracted inward toward the axis. In another example, one gauge pad set of the drill bit may be extended outward from the axis, while another gauge pad set adjacent to that gauge pad set may be retracted inward toward the axis.

In another embodiment of the invention, a system for drilling a cavity is provided. The system may include a first means, a plurality of gauge pad sets, and a second means.

The first means may be for receiving and transferring rotational motion. The first means may include, merely by way of example, a chassis or any other component discussed herein or otherwise now or in the future known in the art for such purposes.

The second means may be for moveably coupling at least one of the gauge pads of at least one of the plurality of gauge pad sets with the first means. The second means may include, merely by way of example, a gauge pad structure or any other component discussed herein or other now or in the future known in the art for such purposes.

Turning now to FIG. 1A, a sectional schematic view of a drill bit 100 or system embodiment of the invention for drilling a cavity is shown where the position of each gauge pad set 110 is controlled as a group. In this example embodiment, each gauge pad set includes three individual gauge pads 111. Drill bit 100 may be coupled with bottom hole assembly 120 by which drill bit 100 is rotated through a medium. Cutters 130 may turn through the medium, removing portions of the medium to define a cavity. Though only two sets of cutters 130 and two gauge pad sets 110 are shown in FIG. 1, it should be understood that many sets of each could exist in any given embodiment, and only two are shown here for clarity and because FIG. 1A is a sectional view, showing only opposing sets.

Gauge pad structures 140 movably couple each gauge pad set 110 with a chassis 150 of drill bit 100. Dashed lines 160 indicate the extent of movement possible of the gauge pad structures 140 and/or gauge pad sets 110. Control system 170 is in communication with gauge pad structures 140 and may direct the movement of gauge pad sets 110 according to internal instructions or instructions received from a remote source.

Figure 1B:
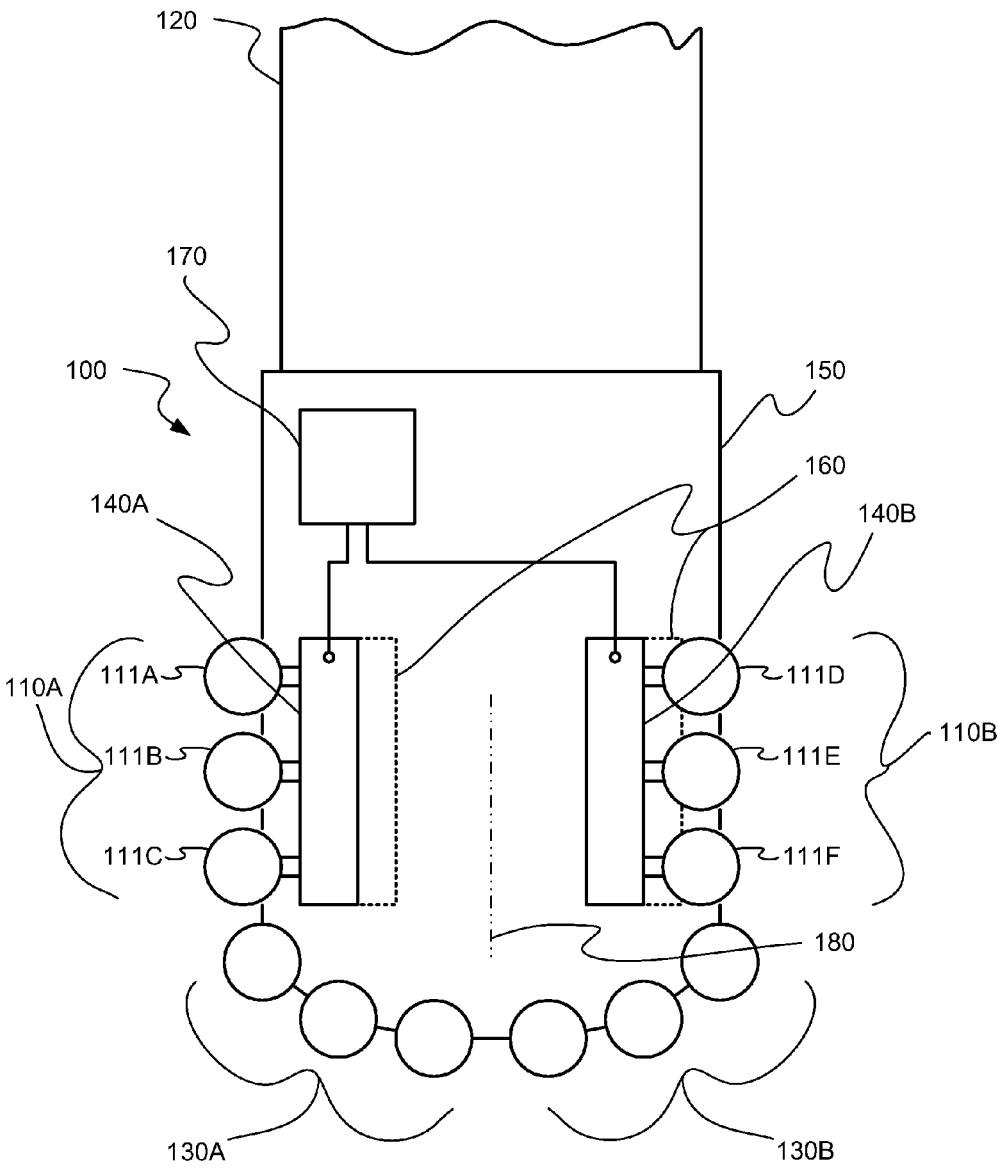
FIG. 1B is a sectional schematic view of the drill bit or system from FIG. 1A showing each gauge pad set in a new position.

FIG. 1B shows a sectional schematic view of the drill bit 100 from FIG. 1A showing each gauge pad set 110 in a new position. In this example, one gauge pad set 110A is extended away from the axis 180, while another gauge pad set 110B is retracted toward axis 180. Other possible positions of the gauge pad sets 110 of drill bit 100 include both gauge pad sets 110 being retracted, and both gauge pad sets 110 being extended.

Figure 2A:
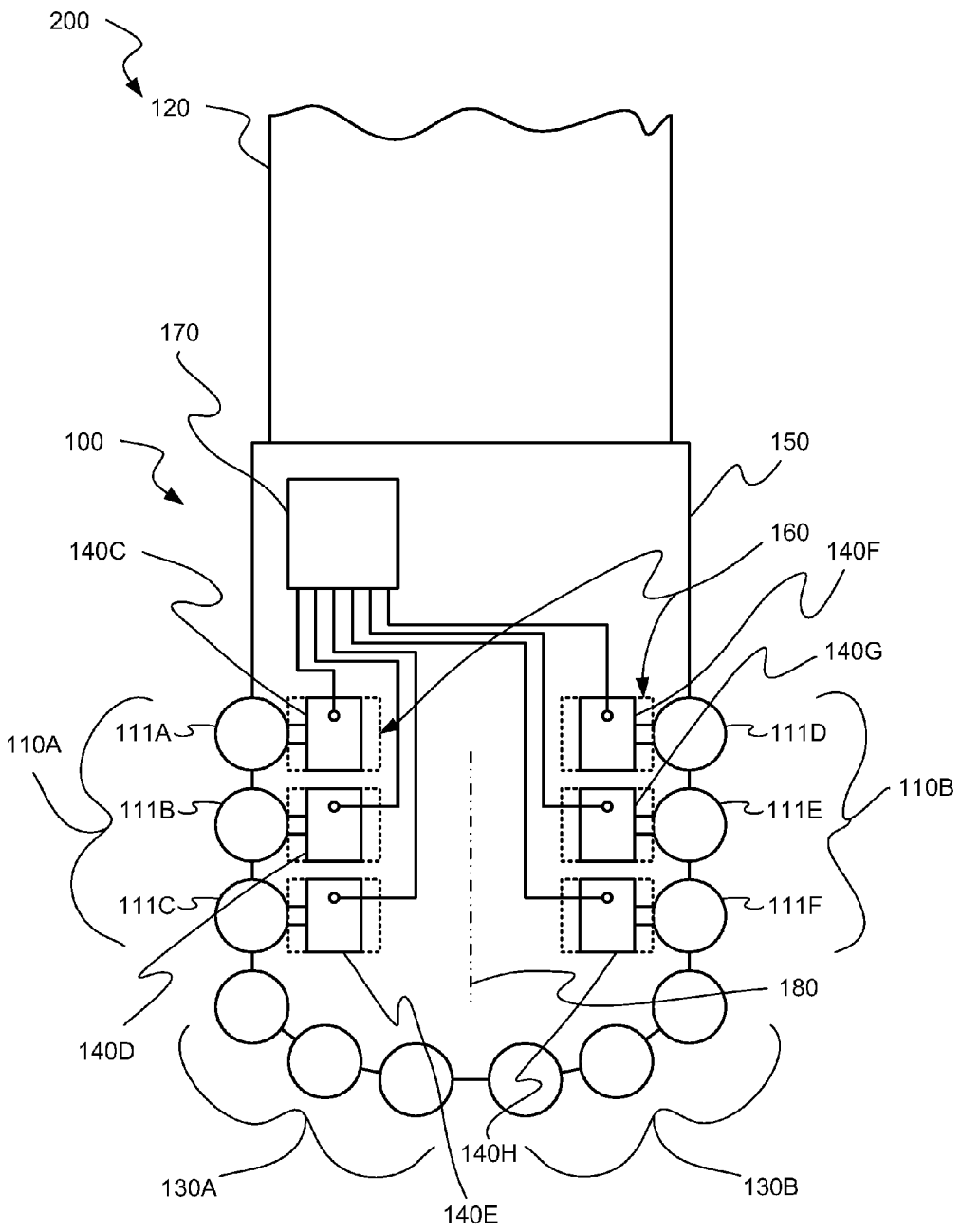
FIG. 2A is a sectional schematic view of a drill bit or system embodiment of the invention for drilling a cavity where the position of each individual gauge pad within each gauge pad set is separately controlled.

FIG. 2A shows a sectional schematic view of a drill bit 200 or system embodiment of the invention for drilling a cavity where the position of each individual gauge pad 111 within each gauge pad set 110 is separately controlled. In this embodiment, controller 170 may direct the positions of each gauge pad 111 independently of all other gauge pads 111.

Figure 2B:
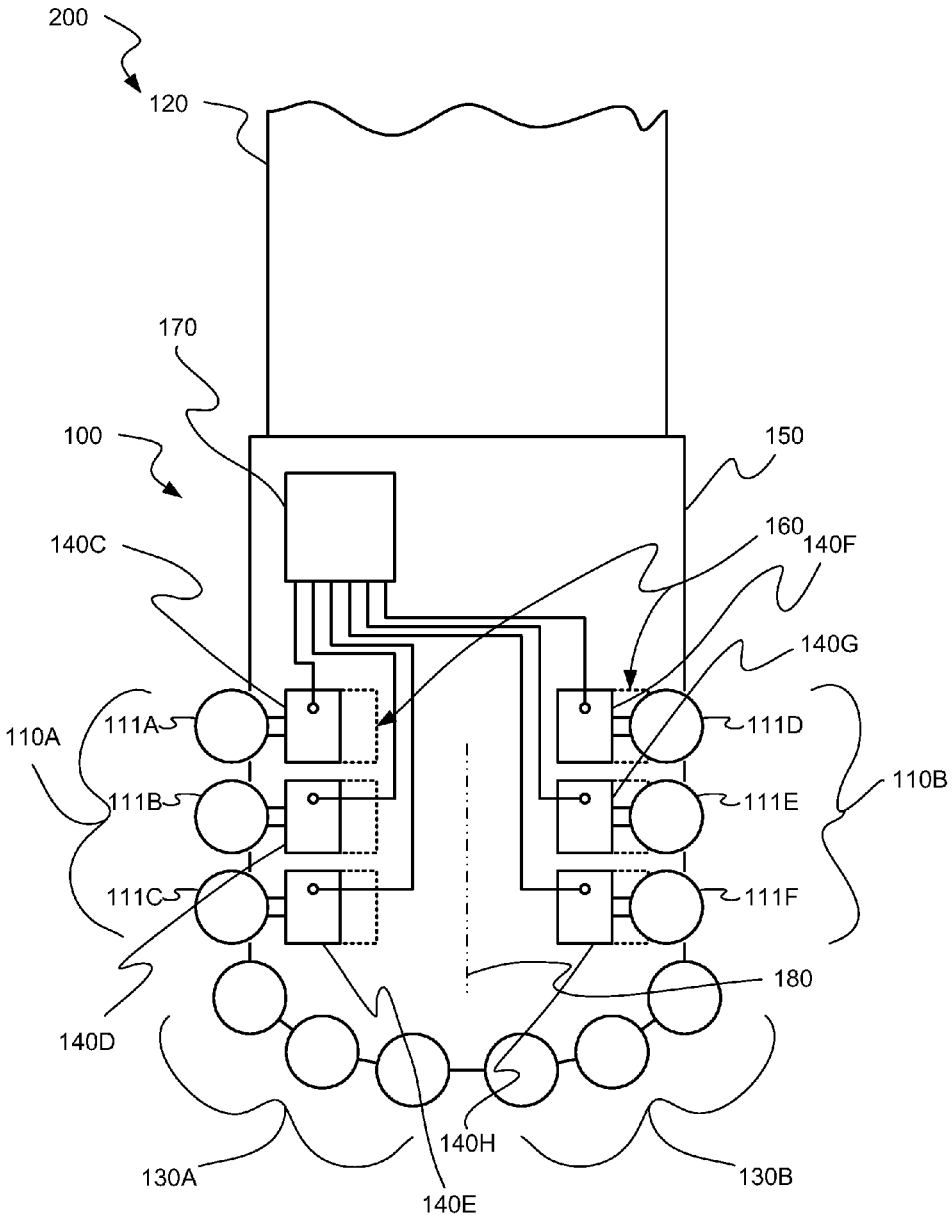
FIG. 2B is a sectional schematic view of the drill bit or system from FIG. 2A showing each gauge pad set in a new position.

FIG. 2B shows a sectional schematic view of the drill bit 200 from FIG. 2A showing each gauge pad set 110 in a new position. In this example, one gauge pad set 110A is extended away from the axis 180, while another gauge pad set 110B is retracted toward axis 180.

Figure 2C:
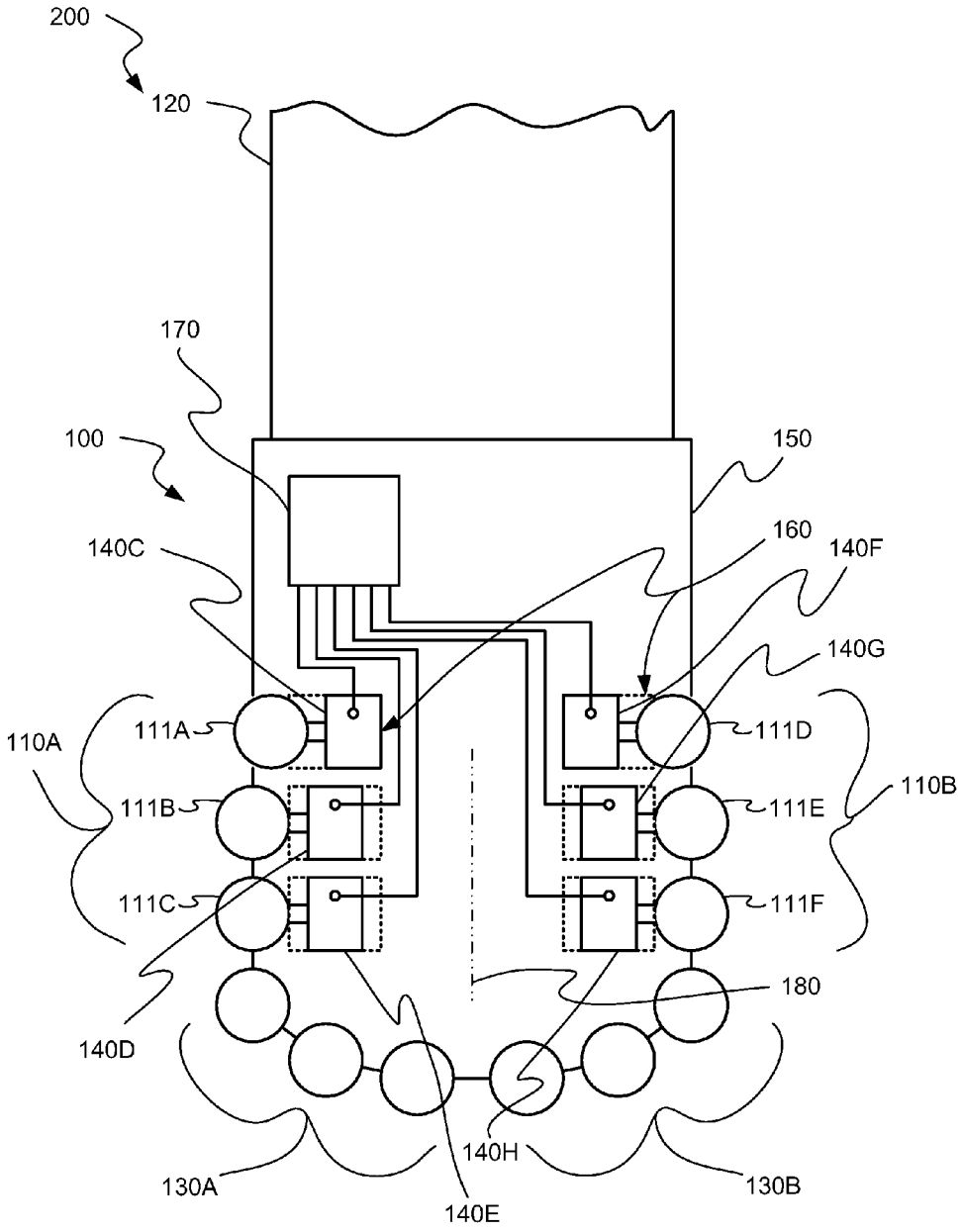
FIG. 2C is a sectional schematic view of the drill bit or system from FIG. 2A showing the last gauge pad in each gauge pad set retracted, thereby shortening the length of each gauge pad set.

FIG. 2C shows a sectional schematic view of the drill bit 200 from FIG. 2A showing the last gauge pad 111A, 111D in each gauge pad set 110 retracted, thereby shortening the length of each gauge pad set 110. In system with more gauge pads 111 in each gauge pad set 110, the length of the gauge pad sets 110 could be varied quite substantially in such embodiments.

Figure 2D:
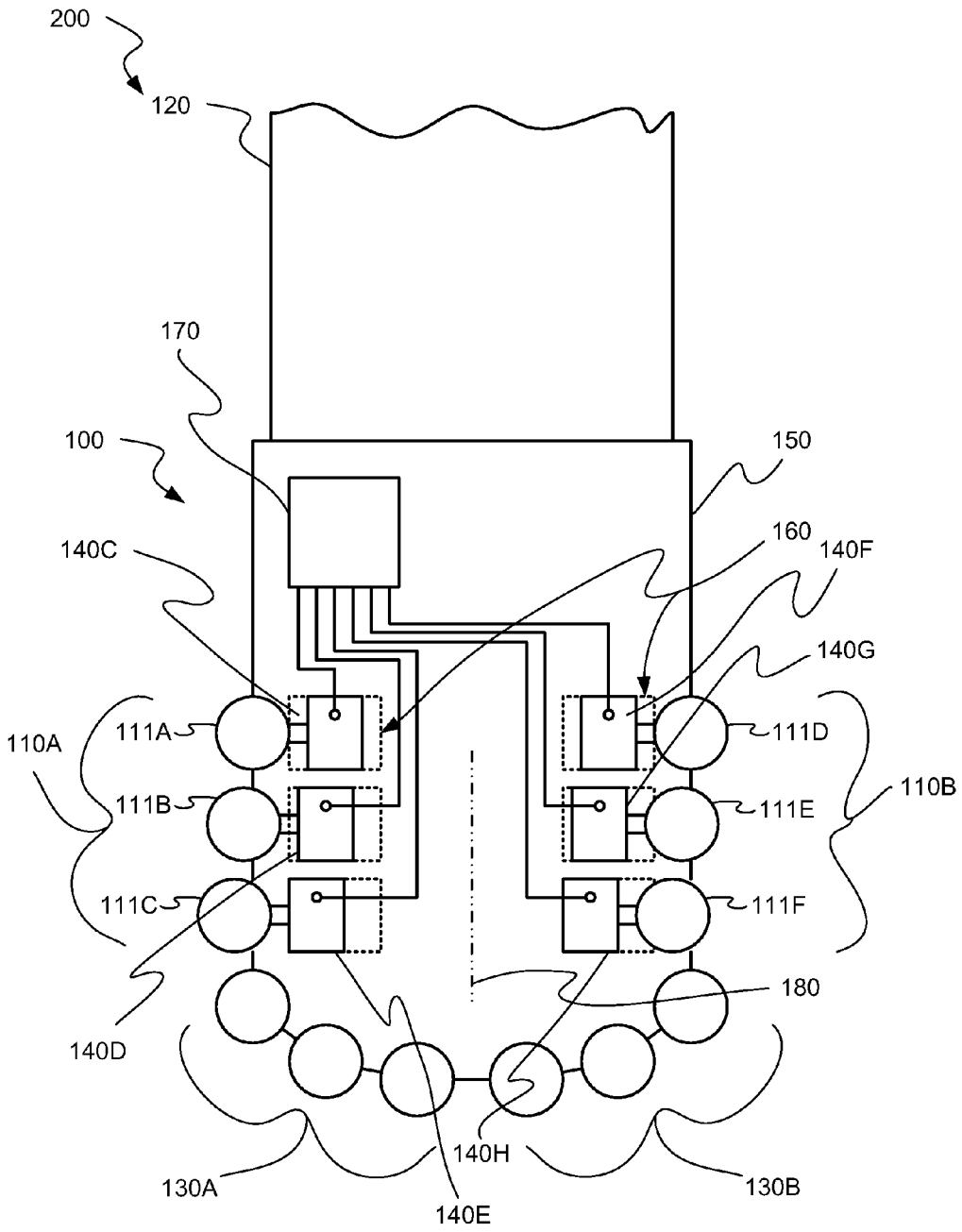
FIG. 2D is a sectional schematic view of the drill bit or system from FIG. 2A showing the gauge pads in each gauge pad set in a staggered position.

FIG. 2D shows a sectional schematic view of the drill bit 200 from FIG. 2A showing the gauge pads 111 in each gauge pad set 110 in a staggered position.

Figure 3:
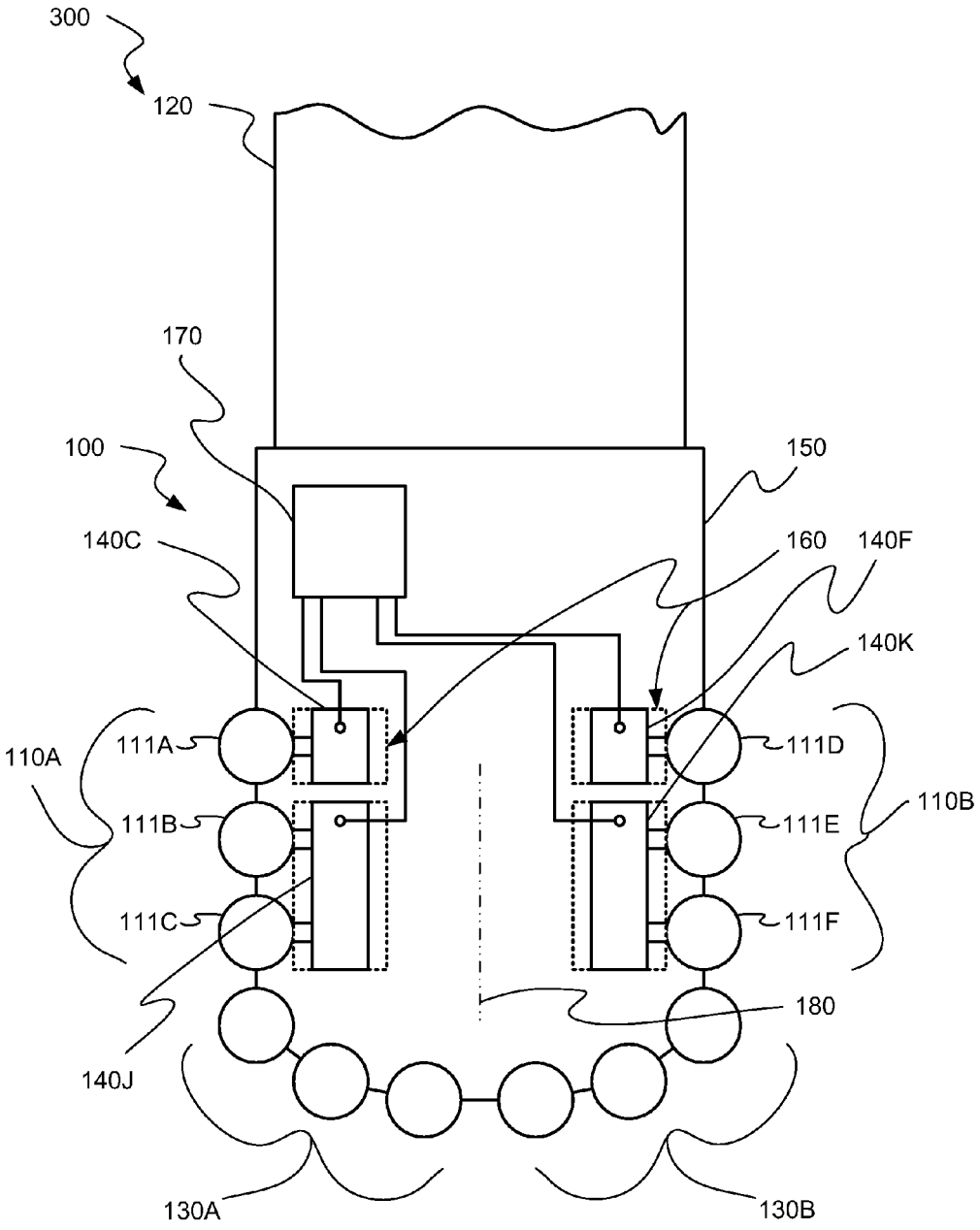
FIG. 3 is a sectional schematic view of a drill bit or system embodiment of the invention for drilling a cavity where the position of some gauge pads in each gauge pad set are controlled as a group, while other gauge pads in the gauge pad sets are controlled individually.

FIG. 3 shows a sectional schematic view of a drill bit 300 or system embodiment of the invention for drilling a cavity where the position of some gauge pads 111B, 111C, 111E, 111F in each gauge pad set 110 are controlled as a group, while other gauge pads 111A, 111D in the gauge pad sets 110 are controlled individually.

Figure 4:
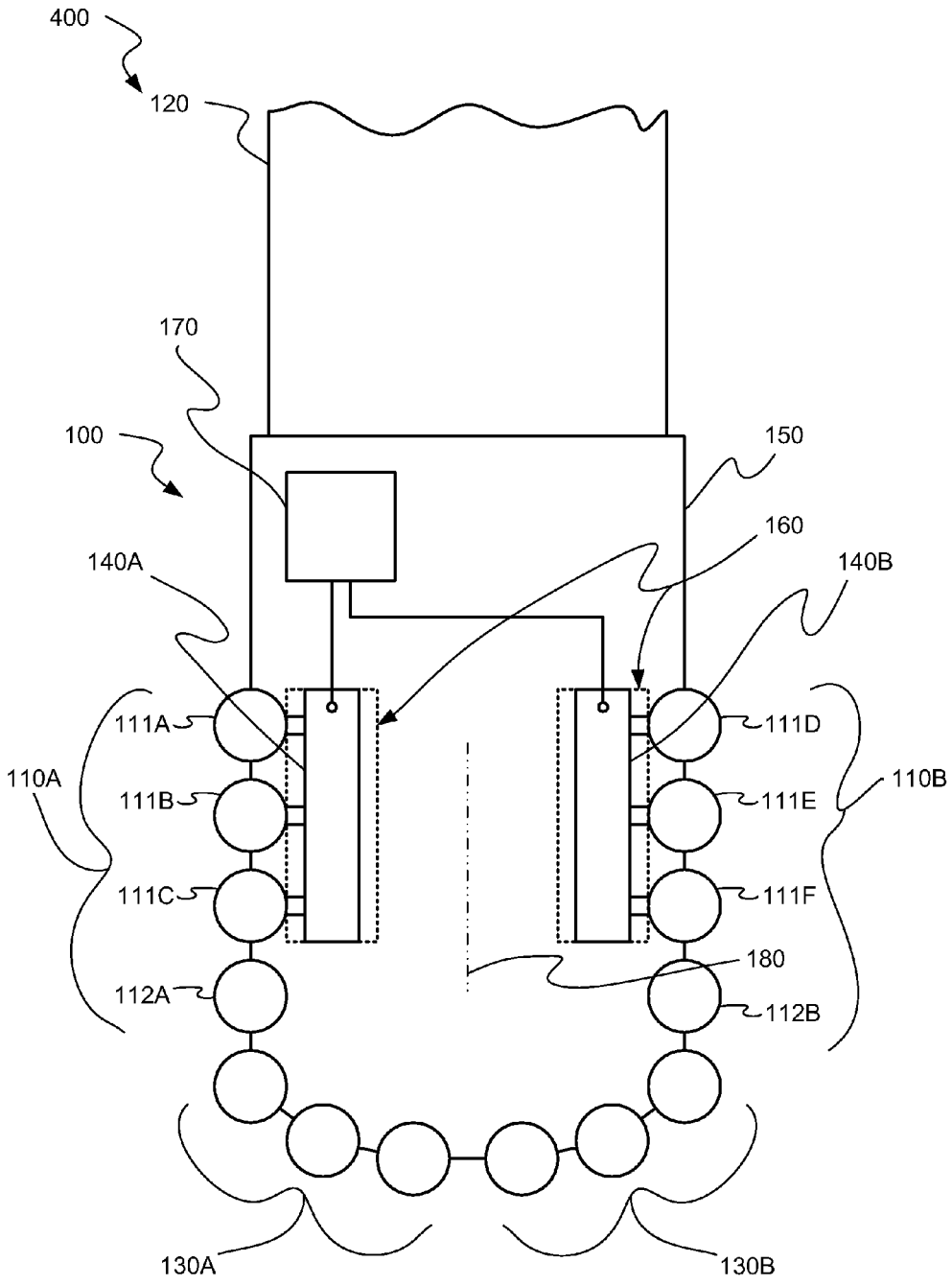
FIG. 4 is a sectional schematic view of a drill bit or system embodiment of the invention for drilling a cavity where the position of some gauge pads in each gauge pad set are controlled as a group, while other gauge pads in each gauge pad set are stationary.

FIG. 4 shows a sectional schematic view of a drill bit 400 or system embodiment of the invention for drilling a cavity where the position of some gauge pads 111A, 111B, 111C, 111D, 111E, 111F in each gauge pad set 110 are controlled as a group, while other gauge pads 112 in each gauge pad set are stationary and rigidly coupled with chassis 150.

Figure 5:
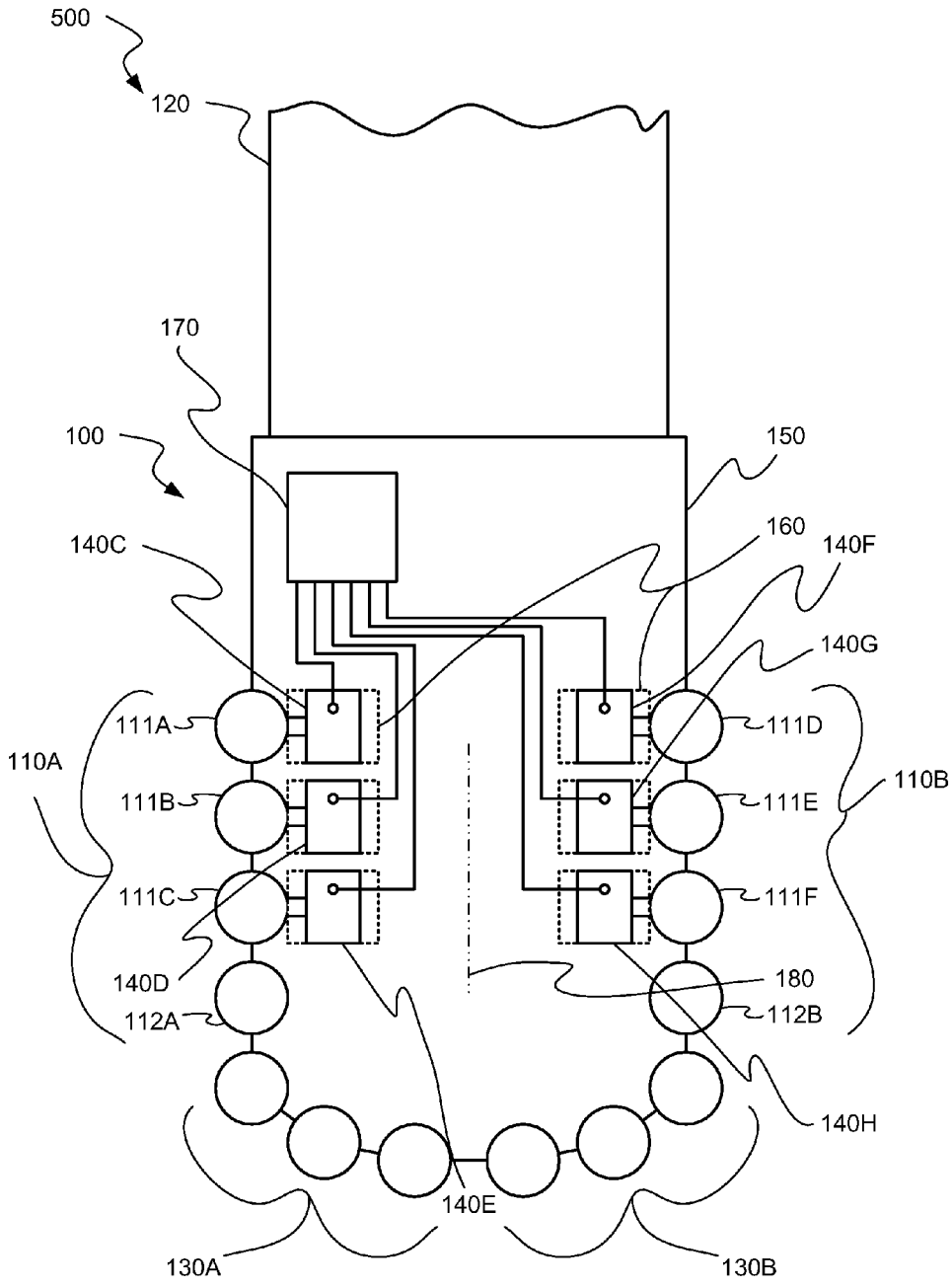
FIG. 5 is a sectional schematic view of a drill bit or system embodiment of the invention for drilling a cavity where the position of some gauge pads in each gauge pad set are controlled individually, while other gauge pads in each gauge pad set are stationary.

FIG. 5 shows a sectional schematic view of a drill bit 500 or system embodiment of the invention for drilling a cavity where the position of some gauge pads 111A, 111B, 111C, 111D, 111E, 111F in each gauge pad set 110 are controlled individually, while other gauge pads 112 in each gauge pad set 110 are stationary.

Figure 6:
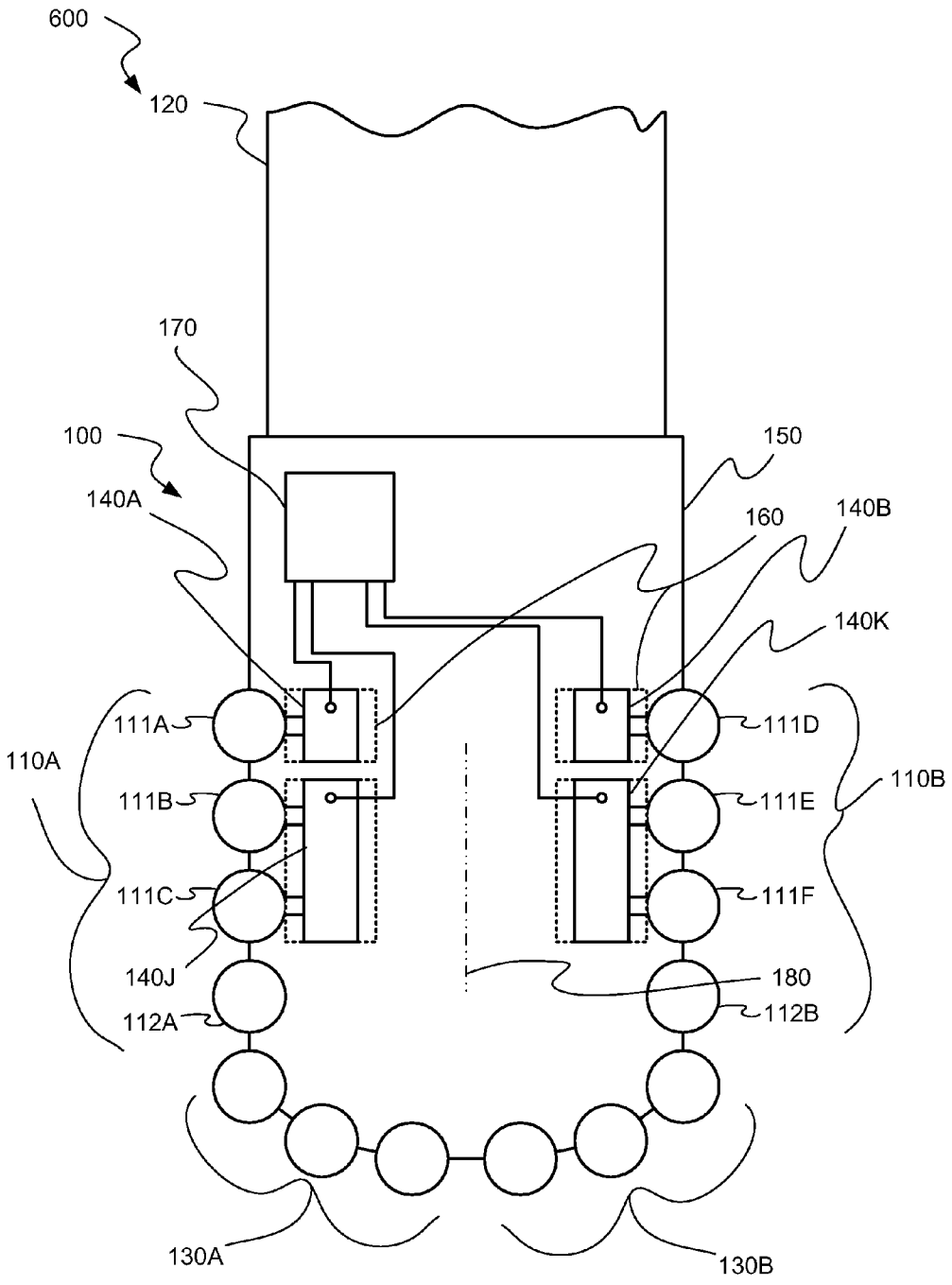
FIG. 6 is a sectional schematic view of a drill bit or system embodiment of the invention for drilling a cavity where the position of some gauge pads in each gauge pad set are controlled individually, others in the set are controlled as a group, while other gauge pads in each gauge pad set are stationary.

FIG. 6 shows a sectional schematic view of a drill bit or system embodiment of the invention for drilling a cavity where the position of some gauge pads 111A, 111D in each gauge pad set 110 are controlled individually, others 111B, 111C, 111E, 111F in the set 110 are controlled as a group, while other gauge pads 1112 in each gauge pad set 110 are stationary.

Figure 7:
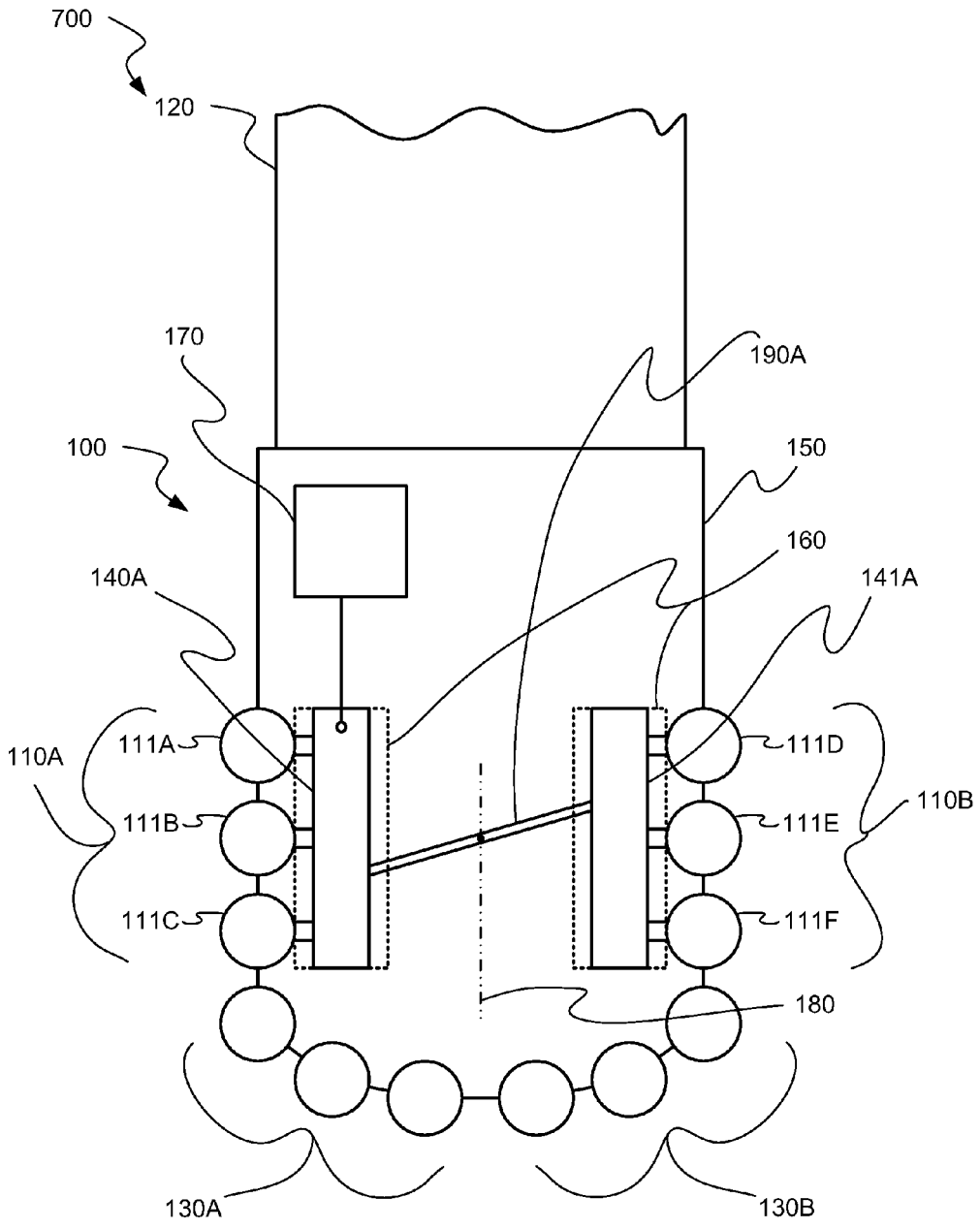
FIG. 7 is a sectional schematic view of a drill bit or system embodiment of the invention for drilling a cavity where the position of a first gauge pad set is controlled as a group, and the position of a second gauge pad set is automatically responsive to changes in position of the first gauge pad set.

FIG. 7 shows a sectional schematic view of a drill bit 700 or system embodiment of the invention for drilling a cavity where the position of a first gauge pad set 110A is controlled as a group, and the position of a second gauge pad set 110B is automatically responsive to changes in position of the first gauge pad set 110A. In some embodiments, a mechanical linkage 190 may cause second gauge pad set 110B to be responsive to changes in position of first gauge pad set 110A. In other embodiments, any other means may be employed to cause the position of second gauge pad set 110B to correspond to that of first gauge pad set 110A, including automatic control via control system 170.

Figure 8:
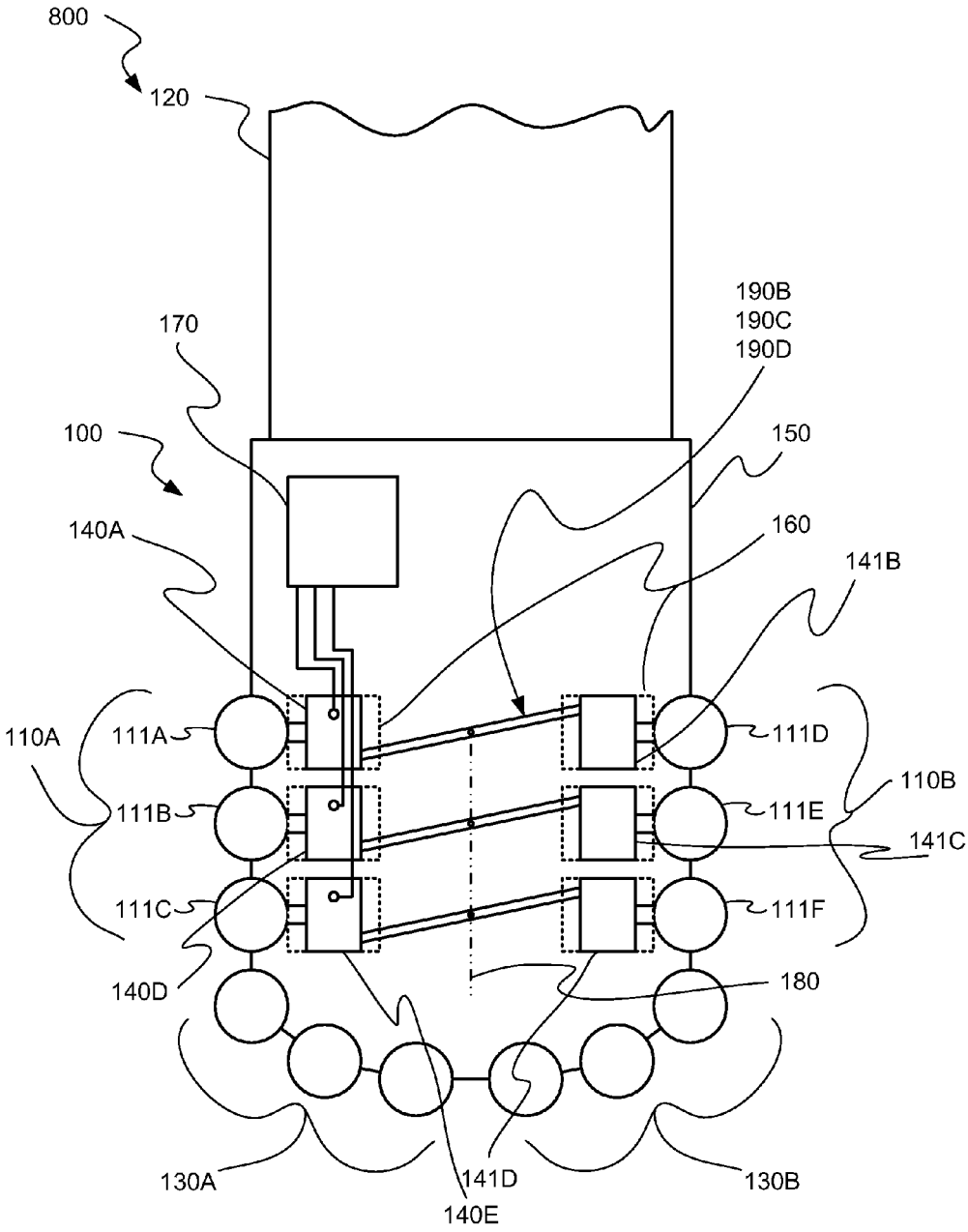
FIG. 8 is a sectional schematic view of a drill bit or system embodiment of the invention for drilling a cavity where the position of each individual gauge pad within a first gauge pad set is separately controlled, and the position of individual gauge pads within a second gauge pad set are automatically responsive to changes in positions of gauge pads in the first set.

FIG. 8 shows a sectional schematic view of a drill bit 800 or system embodiment of the invention for drilling a cavity where the position of each individual gauge pad 111 within a first gauge pad set 110A is separately controlled, and the position of individual gauge pads 111 within a second gauge pad set 110B are automatically responsive to changes in positions of gauge pads 111 in the first set 110A. This drill bit 800 may operate in a manner similar to that of drill bit 700.

Figure 9:
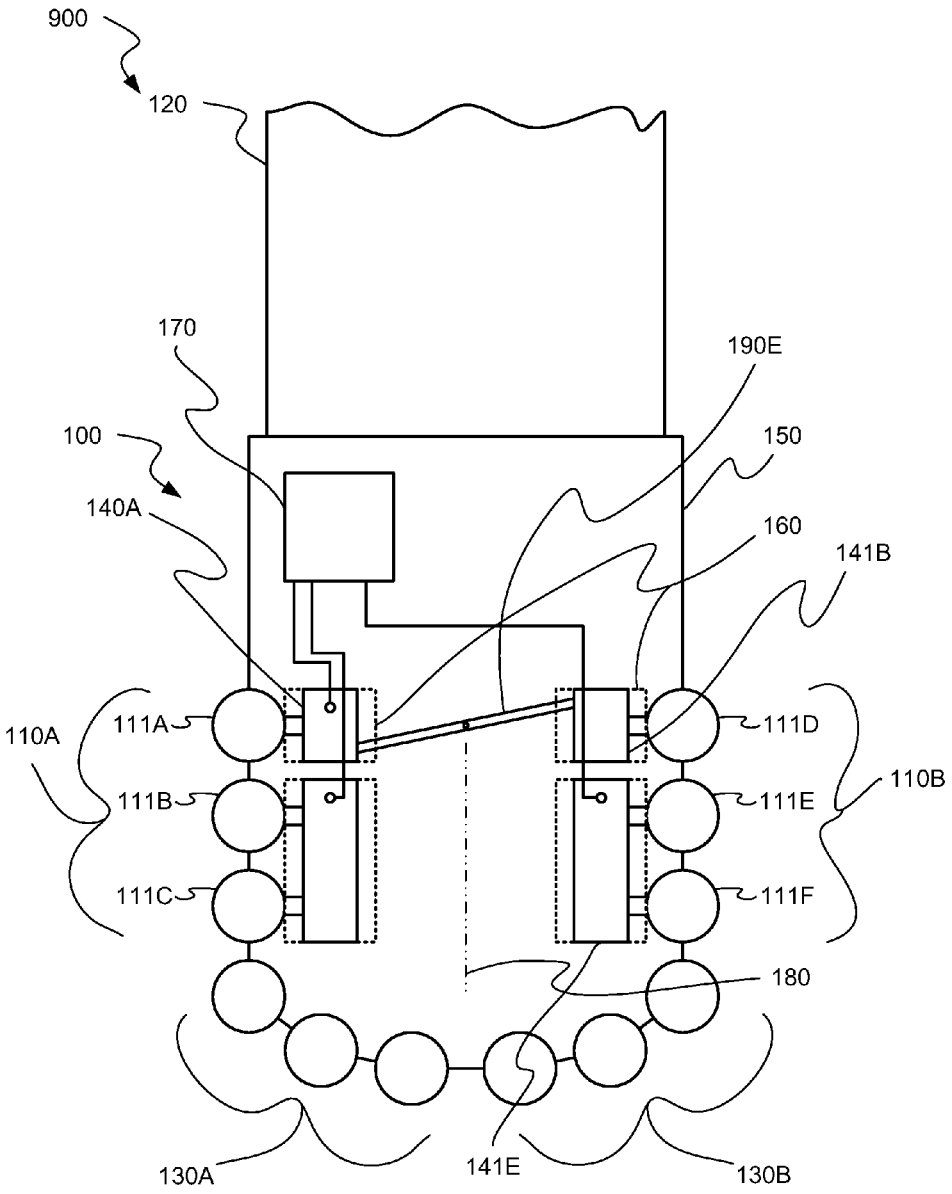
FIG. 9 is a sectional schematic view of a drill bit or system embodiment of the invention for drilling a cavity where the position of some gauge pads in a first gauge pad set are controlled as a group, while other gauge pads in the first gauge pad set are controlled individually, and the position of some corresponding gauge pads within a second gauge pad set are automatically responsive to changes in positions of gauge pads in the first set.

FIG. 9 shows a sectional schematic view of a drill bit 900 or system embodiment of the invention for drilling a cavity where the position of some gauge pads 111B, 111C in a first gauge pad set 110A are controlled as a group, while other gauge pads 111A in the first gauge pad set 110A are controlled individually, and the position of corresponding gauge pads 111 within a second gauge pad set 110B are automatically responsive to changes in positions of gauge pads 111 in the first set 110A.

FIGS. 10A-10D show schematic representations 1000 of a geostationary sequence of positions of gauge pads 111 over time during a drilling operation. In this embodiment, chassis 150 has four gauge pads 111 (which for the purposes of explanation could also be gauge pad sets 110, or portions of gauge pad sets 110), each identified by a letter, A, B, C, or D. FIG. 11 shows a sectional side view 1100 of the system in FIGS. 10A-10D while directionally drilling.

Figure 10A:
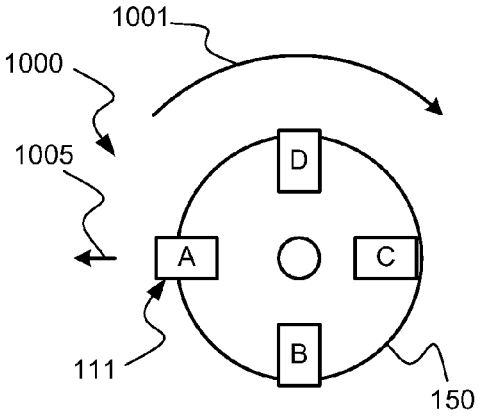
FIGS. 10A-10D are schematic representations of a geostationary sequence of positions of gauge pads over time during a drilling operation.
Figure 11:
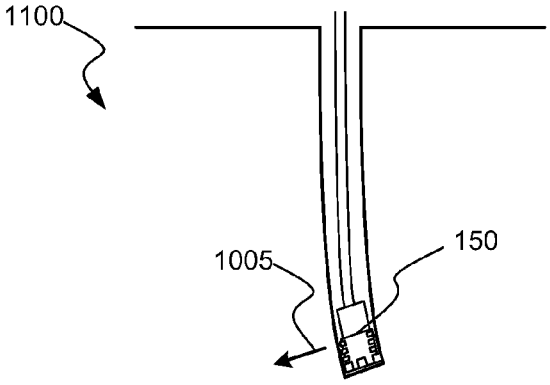
FIG. 11 is a sectional view of the possible results of the drilling operation shown in FIGS. 10A-10D.

In FIG. 10A, chassis 150 is being rotated in the direction of shown by arrow 1001. Gauge pad A is extended in the direction of an absolute radial direction indicated by arrow 1005. Gauge pad C meanwhile is fully retracted. Gauge pad B is in the process of being extended, and gauge pad B is in the process of being retracted.

Figure 10B:
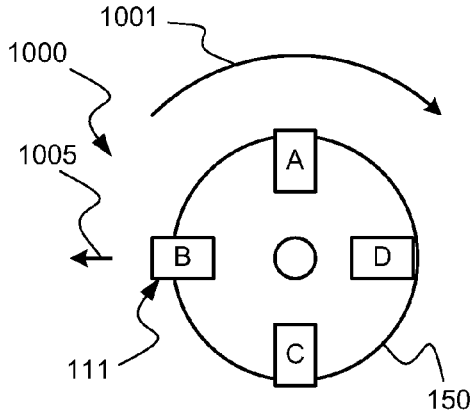

In FIG. 10B, chassis 150 has rotated ninety degrees from FIG. 10A in the direction shown by arrow 1001. Now gauge pad B is fully extended when it faces the absolute radial direction indicated by arrow 1005. Gauge pad D meanwhile is fully retracted. Gauge pad C is in the process of being extended, and gauge pad A is in the process of being retracted.

Figure 10C:
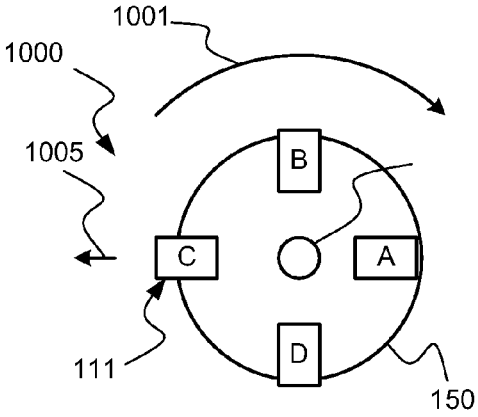
Figure 10D:
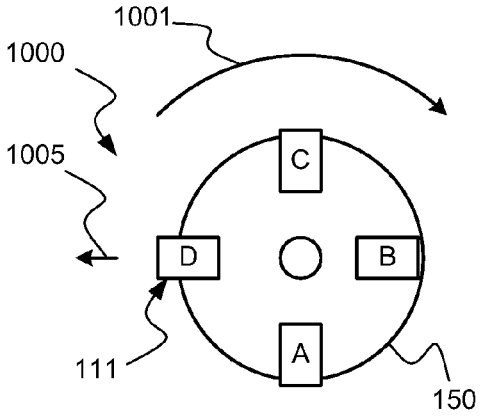

In FIG. 10C, chassis 150 has rotated ninety degrees from FIG. 10B in the direction shown by arrow 1001. Now gauge pad C is fully extended when it faces the absolute radial direction indicated by arrow 1005. Gauge pad A meanwhile is fully retracted. Gauge pad D is in the process of being extended, and gauge pad B is in the process of being retracted.

In FIG. 2D, chassis 150 has rotated ninety degrees from FIG. 10C in the direction shown by arrow 1001. Now gauge pad D is fully extended when it faces the absolute radial direction indicated by arrow 1005. Gauge pad B meanwhile is fully retracted. Gauge pad A is in the process of being extended, and gauge pad C is in the process of being retracted. The process may then be repeated as chassis 150 rotates another 90 degrees presenting gauge pad A toward the absolute radial direction indicated by arrow 1005. Such systems and methods may be used with any number of gauge pads so as to direct the drill in a direction opposing arrow 1005, possibly even in multiple different directions over a varied depth.

Note that the angular position over which gauge pads 111 may be extended may not, in real applications, be as presented as ideally in FIGS. 10A-10D. In real applications, there may be some steering tool face offset. In these situations, the gauge pads may be extended/retracted prior to or after the positions shown in FIGS. 10A-10D to achieve movement away from the direction shown by arrow 1005. Automated systems such as control system 170 may determine the steering tool face offset necessary to achieve the desired directional drilling and modify instructions to the gauge pad structures controlling the movement of gauge pads 111 based thereon. Such automated systems may monitor the effectiveness of a determined tool face offset, and adjust as necessary to continue directional drilling. These systems may be able to differentiate between "noise" fluctuations and real changes.

In FIG. 11, it will be recognized how repeating the process detailed above can result in a directional bore hole. Also recognizable is how the absolute radial direction may slowly change as the angle of bore hole changes due to directional drilling. If directional operation continues, then the bore hole may continue to "curve." Alternatively, once a certain angle of bore hole has been achieved, straight drilling may recommence by allowing the gauge pad structures in the chassis to equalize the extension of all gauge pads, assisting substantially symmetrical drilling around the perimeter of the chassis and straight bore hole drilling in the then current direction. Additionally, cyclical variation of the gauge pads may also allow for straighter drilling, especially when boundaries between different earthen formations (particularly steeply dipping formations) are crossed.

A number of variations and modification of the invention can also be used within the scope of the invention. For example, stabilizers positioned above the drill bit in the drill string could utilize systems and methods of the invention to provide variable gauge stabilization at relevant portions of the drill string. Such biasing could also at least assist in steering of the drill string and/or drill bit. Additionally, stand drill bits could be utilized with variable gauge bad subcomponents employed "behind" the standard drill bits to provide the advantages of the invention in aftermarket tooling for conventional bits.

The invention has now been described in detail for the purposes of clarity and understanding. However, it will be appreciated that certain changes and modifications may be practiced within the scope of the appended claims.

What is claimed is:

1. A drill bit for drilling a cavity, wherein the drill bit comprises:

a chassis configured to rotate about an axis;

a plurality of gauge pad sets each gauge pad set comprising at least one gauge pad;

a plurality of gauge pad structures moveably coupling a plurality of the gauge pads with the chassis, wherein the plurality of gauge pad structures moveably coupling a plurality of the gauge pads with the chassis comprises at least one of the gauge pads of at least one of the plurality of gauge pad sets being coupled with at least one of the gauge pads of at least one other of the plurality of gauge pad sets; and a control system configured to control the a position of two or more of the plurality of gauge pads, wherein the control system controls the position of the two or more of the plurality of the gauge pads to define a gauge pad profile and wherein:

the drill bit comprises a plurality of cutters and the cutters define a cutting diameter of the drill bit;

the control system controls at least two of the plurality of gauge pads to define a variable gauge diameter between a first diameter and a second diameter; and the first diameter is about 1 millimeter less than the cutting diameter and the second diameter is about 1 millimeter greater than the cutting diameter.

2. The drill bit for drilling a cavity of claim 1, wherein each gauge pad set comprising at least one gauge pad comprises each gauge pad set comprising a plurality of gauge pads.

3. The drill bit for drilling a cavity of claim 1, wherein:

each gauge pad set comprising at least one gauge pad comprises each gauge pad set comprising a plurality of gauge pads; and each plurality of gauge pads comprises a substantially linear arrangement of gauge pads along a length of a side of the drill bit.

4. The drill bit for drilling a cavity of claim 1, wherein the plurality of gauge pad structures moveably coupling a plurality of the gauge pads with the chassis comprises at least one of the gauge pads of at least one of the plurality of gauge pad sets being movable in a radial direction relative to the axis.

5. The drill bit for drilling a cavity of claim 1, wherein the drill bit further comprises at least one gauge pad rigidly coupled with the chassis.

6. The drill bit for drilling a cavity of claim 1, wherein the gauge pad structure comprises a selection from a group consisting of:

a hydraulic piston;

a spring;

a magnetorheological fluid piston;

an electrorheological fluid piston;

an electroactive polymer piston;

a mechanical actuator; and an electric actuator.

* * * * *